United States Patent [19]

Garrett

[11] 4,416,476

[45] Nov. 22, 1983

[54] INTERMEDIATE WEIGHT DRILL STEM MEMBER

[75] Inventor: William R. Garrett, Conroe, Tex.

[73] Assignee: Oncor Corporation, Houston, Tex.

[21] Appl. No.: 208,987

[22] Filed: Nov. 21, 1980

Related U.S. Application Data

[63] Continuation-in-part of Ser. No. 188,027, Sep. 17, 1980, abandoned.

[51] Int. Cl.[3] ..... F16L 15/00

[52] U.S. Cl. ..... 285/286; 285/333

[58] Field of Search ..... 285/286, 333, 334

[56] References Cited

U.S. PATENT DOCUMENTS

| | | | |
|---|---|---|---|
| 2,073,093 | 3/1937 | Brantly . | |
| 2,259,232 | 10/1941 | Stone . | |
| 2,301,495 | 11/1942 | Abegg . | |
| 2,664,272 | 12/1953 | Boice . | |
| 2,676,820 | 4/1954 | Boice | 285/333 X |
| 2,969,845 | 1/1961 | Hester . | |
| 3,080,179 | 3/1963 | Huntsinger . | |
| 3,152,458 | 10/1964 | Simonin . | |
| 3,193,918 | 7/1965 | Heldenbrand . | |
| 3,458,922 | 8/1969 | Schellstede et al. . | |
| 3,484,122 | 12/1969 | Schellstede et al. | 285/286 |
| 3,773,359 | 11/1973 | Chance et al. . | |
| 3,784,238 | 1/1974 | Chance et al. | 285/286 X |
| 4,240,652 | 12/1980 | Wong et al. | 285/333 X |

OTHER PUBLICATIONS

API Standards, FIGS. 10.4, 10.7, 10.3, 10.2, 6.8, 6.6, Current.

Drilco Catalog, p. 2503, Copyright 1979.

Reed Hester Drill Pipe Saver Advertisement, Date Unknown, Reed Roller Bit Co.

*Primary Examiner*—Thomas F. Callaghan

*Attorney, Agent, or Firm*—Vaden, Eickenroht, Thompson, Bednar & Jamison

[57] ABSTRACT

An intermediate weight drill stem member having a tool joint or end with at least one reduced diameter surface for hoisting and handling protected by an enlarged diameter wear protecting length on either side thereof and providing at its junction end with the tubular body a straight-wall surface, a length having a diameter less than the maximum diameter of the adjacent enlarged length, for welding to a straight-wall length of the contiguous externally upset end of the tubular body. The tubular body is preferably about twenty feet long compared to a combined length of ten feet for the two tool joints, thereby eliminating a need for an intermediate wear protector length along the tubular body length.

14 Claims, 3 Drawing Figures

30
32
34
36
38
40
16
42
12
10
18
24
14
22
20

58
56
50
54
60
52
62
64
66
68
16

82b
80b
84b
86b
86a
84a
80a
82a

INTERMEDIATE WEIGHT DRILL STEM MEMBER

This application is a continuation-in-part of copending application Ser. No. 188,027, entitled "Intermediate Weight Drill Stem Member", filed Sept. 17, 1980, now abandoned.

BACKGROUND OF THE INVENTION

1. Field of the Invention

This invention pertains to a drilling string member and more particularly to an intermediate weight drill string member.

2. Description of the Prior Art

An intermediate weight drill string member, usually merely referred to as an "intermediate drill stem", can be employed in a drill string for any one of a number of reasons. It is normally employed between the drill collars and the drill pipe in a drill string to provide a gradual transition in rigidity/flexibility between the rigid drill collar parts and the comparatively flexible drill pipe parts.

One application of an intermediate drill stem is to supply weight to the bit in directional drilling. Such a stem provides sufficient flexure to bend around the curves encountered in directional holes without creating high torque and drag which occur when using relatively stiff drill collars. Such a stem is not too flexible, however, so as to provide not too much bending, which is often true of a relatively light drill pipe member alone. Also, such a member does not exhibit as much fatigue as a drill pipe member.

Another application of an intermediate drill stem is that it permits drilling under compression. When drilling vertical holes in relatively soft formations intermediate drill stem members can even be used in place of drill collar members. Drill pipe, on the other hand, is usually driven under conditions of tension and cannot be employed where compression conditions constantly exist.

Thus, an intermediate drill stem normally is employed in a transitional position between the drill collar members and the drill pipe members at a distance of about 600 to 2000 feet above the drill bit for providing some additional weight to the drill collar members where necessary and to prevent compression from being unnecessarily applied to the drill pipe members, the intermediate drill stem location sometimes being under compression and sometimes under tension during a drilling operation.

Virtually all drill pipe employed in oil field drilling includes tool joints, with the working threaded connections being welded to a center tube. Such tool joints or ends normally range in length up to about two feet and, when joined to a tube, make up a drill pipe that is about 30 feet in length. It can be seen that when a tool joint is damaged or otherwise unsuitable for service while the tube is not, it is possible to cut the bad joint off, clean up the remainder of the pipe and add a good joint or end thereto, thereby making a good and whole pipe again.

Both in the orignal making and in the remaking of pipe, the petroleum industry does not accept a weld between the tube or body length of the drill pipe and the tool joint or end which weld has the same cross-sectional area as the tube. This is because the weld and the heat affected zone adjacent the weld has a lower breaking stress capacity than the tube. Therefore, to make the weld as strong as the tube itself, the weld must be thicker.

Most drill pipe used today has an internal upset on each end of the tube to provide the necessary extra thickness where welding takes place. Some tube or body lengths are also slightly externally upset, as well.

U.S. Pat. No. 3,784,238, Chance, et al., shows a tube, the end of which is upset to provide a shoulder in which the weld is made to the tool joint. This shoulder is also the surface which is used for handling of the drill pipe by elevators and slips. Finally, it is known, but not commonly done, to form or upset the end of the tube to be of the same thickness as the tool joint so that the welding is done on the full thickness of the tool joint.

All of these prior art schemes have shortcomings. The most popular weld junction at an internal upset or at an internal upset where there is also some external upset reduces the internal bore dimension of the pipe at the weld and tool joint. When the weld is made at an external upset at a step below the shoulder, the bore is not reduced but the weld is not protected against such things as the creation of a mud ring or from being scarred by the elevators and slips. When an attempt then is made to make a new elevator shoulder by machining away a scarred one, this would be unsatisfactory since the weld area would be machined away as well, thereby reducing the wall thickness at the weld to be the same thickness as the wall of the body of the pipe, which as noted above, it is unacceptable in the industry.

To be acceptable in the industry, an intermediate drill stem should have the following properties: (1) be reasonably flexible, (2) have the same approximate outside geometry as the conventional drill pipe above the intermediate drill stem, and (3) be as heavy per unit length as possible. To elaborate, the intermediate drill stem must be sufficiently flexible that it can bend through curves without creating excessive friction and drag. It must be externally sized so that the same hoisting and handling equipment (e.g., slips and elevators) can be used for both conventional and intermediate drill stem members. The wall thickness should be as great as possible, thereby creating as small a bore as permissible, giving consideration to hydraulic pressure loss and the size of tools that must pass internally through the drill stem.

With the above in mind, the selection of the elevator shoulder for the weld in the intermediate drill stem shown in U.S. Pat. No. 3,784,238 was a logical choice. While this has been a satisfactory design for many commercial applications, there have been three distinct problems with such a location.

As mentioned above, elevator shoulders are subject to wear in service and can become grooved and uneven. Such wear can damage elevators when the seating surfaces do not match. A worn elevator shoulder cannot be machined back without losing the safety factor of the extra thickness of the weld area. Hence, the pipe length must be scrapped when this happens.

Second, all welds on heat treatable steel, from which all modern oil field drill stems are made, should receive some type of post-thermal treatment. Preferred methods of post-thermal treatment cannot be employed to a weld on a tapered surface.

Third, the process control of making a weld on a tapered surface is more difficult than on a straight diameter section. This means that not only is it more expensive to make welds on tapered surfaces, but there is a greater percentage of such welds that fail inspection.

When a weld does not pass final inspection, parts can seldom be salvaged.

Therefore, it is a feature of the present invention to provide an improved technique of joining a tool joint or end to a drill pipe that eliminates placing a weld on a shoulder while meeting all the other requirements for an intermediate drill stem.

It is yet another feature of the present invention to provide an improved intermediate drill stem wherein the welding to the tube is not near or in the elevator shoulder, such shoulder also being isolated and protected from wear.

The mathematical analysis of a drill stem member is exceedingly complex. However, in one sense, it can be viewed as a slender column or strut which is subject to Euler's Formula. This formula pertains to the fact that when a load-bearing body in compression has a length more than ten or twelve times its least dimension perpendicular to the load line, simple compression ceases to be the direct cause of failure. Instead, failure occurs as a result of lateral deflections, which, in turn, depends on the modulus of elasticity of the material and the slenderness ratio of the member, as well as the crushing strength of the material. In addition, the load-carrying capacity is dependent on the condition of restraints on the column ends (e.g., guided free end, fixed ends, one end guided and one end fixed, and one end free and one end fixed). A drill stem member is not clearly any one of the above, but safe approximate values can be applied in Euler's Formula to determine the critical buckling load for a drill pipe.

By considering the tool joints or ends as stiff, the prior art intermediate drill pipe would normally have about a four-foot length (two ends each two feet long) and then a twenty-six-foot length (length of the body of the member). Before the critical buckling load was met, such a pipe could flex about 8.7 inches. A 5-inch tube operating in the center of a 10-inch hole would easily contact the wall long before the buckling load was met. A typical diameter of 6½ inch tool joint would also permit such flexing. Therefore, in U.S. Pat. No. 3,784,238, a wear pad or protector is provided by building up the wall of the body of the pipe length intermediate the ends of the pipe, preferably approximately at the mid point.

As will be noted hereinafter the combined length of the tool joints or ends of the member disclosed herein is approximately ten feet. Hence, for a normal thirty-foot pipe, there is a tube or body length of approximately twenty feet. A 10-foot length, 6½ inches in diameter would only allow an angling in a 10-inch borehole of about 1.7°. The twenty-foot length would only bend about 0.9 inch before it reached its critical buckling load, which would be far short of contacting the wall of the borehole. Hence, in the present design, there is no need for an intermediate wear pad or protector.

Therefore, still another feature of the present invention is to provide an improved intermediate drill stem not requiring an intermediate wear or protective built-up external surface.

SUMMARY OF THE INVENTION

The emodiments of the intermediate drill stem inventions herein disclosed each include a tubular body having conventional drill pipe wall thickness externally upset at either end. Preferably the length of such body is twenty feet. The tool joint or end which is joined to such a body includes one or more surfaces for handling and hoisting with elevators, slips, tongs or the like, which surfaces include at least one reduced external diameter and an adjacent shoulder or radius upward therefrom to an enlarged external diameter. At the lower end of the lowest of these reduced surfaces is another enlarged external diameter that steps down to the same external dimension as the tubular body upset. Welding, such as typically stub welding, is provided in this step, which is at a greater thickness than the normal body thickness and is not on a tapered surface.

BRIEF DESCRIPTION OF THE DRAWINGS

So that the manner in which the above-recited features, advantages and objects of the invention, as well as others which will become apparent, are attained and can be understood in detail, more particular description of the invention, as well as others which will become apparent, are attained and can be understood in detail, more particular description of the invention briefly summarized above may be had by reference to the embodiments thereof which are illustrated in the appended drawings, which drawings form a part of this specification. It is to be noted, however, that the appended drawings illustrate only preferred embodiments of the invention and are therefore not to be considered limiting of its scope, for the invention may admit to other equally effective embodiments.

Figure 1:
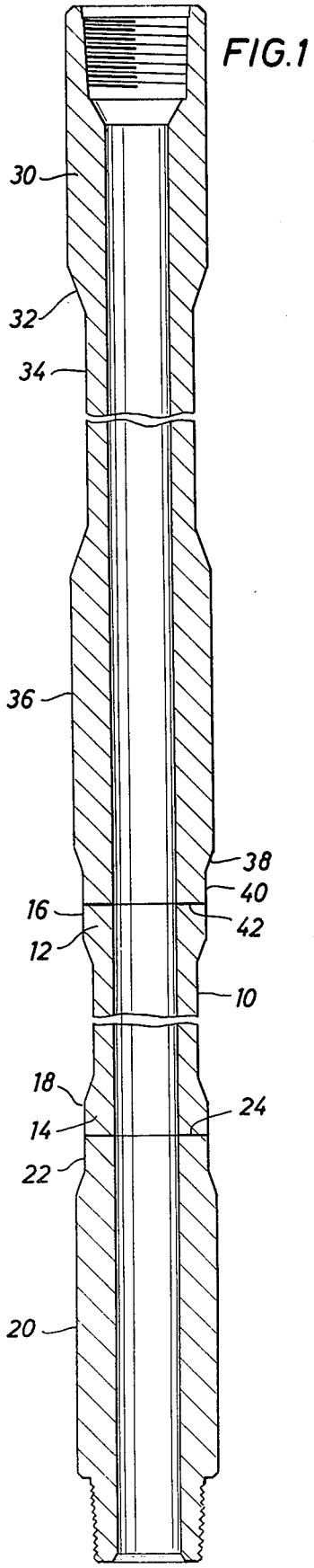

IN THE DRAWINGS:

FIG. 1 is a longitudinally cross-sectional view of a preferred embodiment of a drill stem member in accordance with the present invention.

Figure 2:
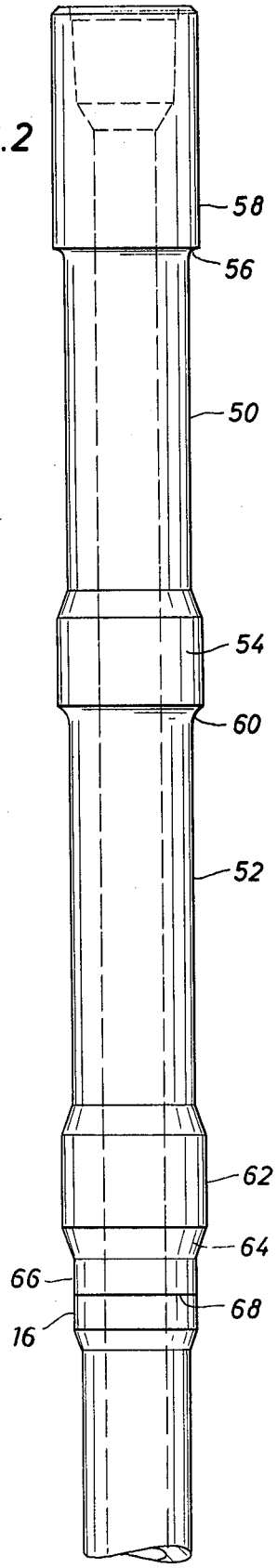

FIG. 2 is a fragmentary longitudinal plan view of another preferred embodiment of a drill stem member in accordance with the present invention.

Figure 3:
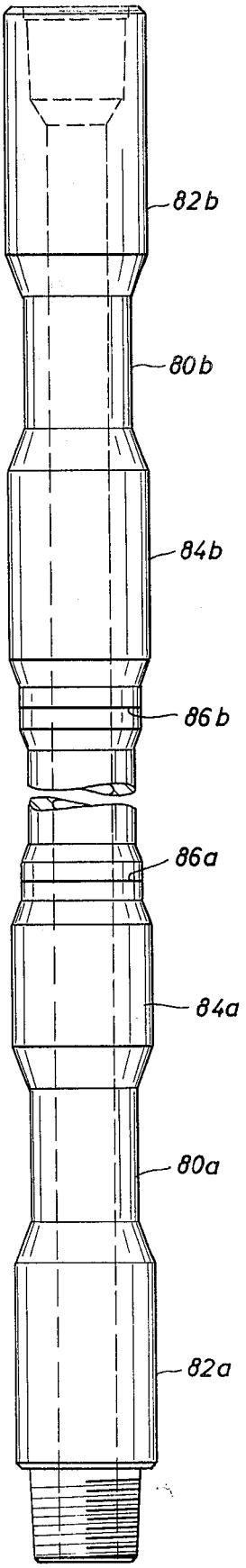

FIG. 3 is a fragmentary longitudinal plan view of yet another preferred embodiment of a drill stem member in accordance with the present invention.

DESCRIPTION OF THE PREFERRED EMBODIMENTS

Now referring to the drawings, and first to FIG. 1, a drill stem member is shown having a tubular body 10 in accordance with conventional drill pipe wall diameter and thickness. Although there are many common sizes, a very popular size drill pipe is 5 inches in external diameter with a wall thickness of one inch. The tool joints are conventionally made of alloy steel having a yield strength of at least 120,000 psi with the tubular portion of a pipe having a lower strength; however, the present invention is not limited to any particular type of material. Body 10 is externally upset at either end 12 and 14 to provide steps 16 and 18, respectively, which are approximately parallel to the longitudinal axis of the pipe.

As shown in the drawing, the lower tool joint or end 20 is the pin connector, suitably threaded for connection into the box of the adjacent drill stem member. The connector for joining to a 5-inch tube body conventionally has an outside diameter of 6½ inches and an inside diameter of 3 inches. The connector hardness, thread form, shoulder height, and distance from shoulder to thread is preferably that of conventional rotary shoulder connectors for tool joints and drill collars. At the upper end of tool joint 20, the external diameter is stepped down to surface 22, which is at the same approximate diameter of adjoining surface 18. Also, step 22 is substantially parallel to the axis of the tube. Weld 24 produced by stub welding or otherwise joins tube 10 to tool joint 20. It should be noted that the wall thickness at the weld is greater than the wall thickness of tube 10 but not so thick as the wall thickness of joint 20. Overall, tool joint 20 is approximately two feet long.

The box tool joint includes a little more complex set of surfaces than the pin tool joint just described. Box 30 is suitably threaded at its internal bore for joining an adjacent drill stem member. At a lower location about two feet from the end, the outside diameter reduces at tapered shoulder 32 to a recess length or area 34. Recess area 34 is approximately three feet long and has a wall thickness approximately the same as for body 10. This area and the shoulder thereabove provides an area for hoisting and handling the pipe with elevators, slips and the like. Shoulder 32, in fact, is sometimes referred to as an "elevator shoulder".

At the lower end of recess 34, the wall thickness again becomes thicker via an enlargement of the external diameter and there is provided below recess 34 approximately a 3-foot wear protector length 36 with a wall thickness about equal to the tool joints. At the lower end of protector length 36, there is a shoulder 38 that reduces to a step dimension 40. This dimension is approximately the same as adjacent upset end 12 and the surface is contiguous with surface 16 and parallel to the axis of the body. Weld 42 joins body 10 to tool joint 30 by stub welding or the like in the same manner as for weld 24.

The wall dimension of a conventional drill pipe range in thickness dimension up to about 0.5 inches. To gain the advantages of an intermediate drill stem, the wall thickness must be greater than 0.62 inches. Therefore, body 10 and area 34 dimensionally for intermediate drill pipe must each have a wall thickness of at least 0.62 inches. Further to provide the safety expected by the industry, a weld should be 20 percent thicker than the homogeneous length of the pipe. Therefore, each upset step 16 and 18 and their respective contiguous steps to which they are welded are 20 percent thicker in wall dimension than the wall thickness of body 10. For a tubular body having a wall thickness of 0.62 inches, the upset end must have a thickness of 0.744 inches to be acceptable to the industry.

It should be noted that tool joint 20 is approximately two feet long, tool joint 30 is approximately eight feet long, and tube body 10 is approximately 20 feet long. Area 34 and shoulder 32 are protected by protector 36 and there is no welding near or in shoulder 32, the inhomogeneous connection or weld between the tube body and the tool joint being below protector 36. The weld is at an enlarged external diameter to that of the tubular wall, but is not on a taper and not external to the thickest wall portion of the protector or tool joint. There is no protector length between welds 24 and 42 or in the length of the tube body.

FIG. 2 illustrates another tool joint of approximately eight feet in length in which there is a recess area 50 suitable for elevator manipulation and a recess area 52 separated therefrom for slip manipulations. Separation of the recess areas is by way of externally enlarged protector area 54. There is a small cold worked radius 56 at the upper end of recess 50, which extends outwardly to an enlarged protector end 58 and there is a similar small radius 60 joining recess 52 to protector 54.

Protector 62 having an enlarged external diameter is connected below recess 52. Protector 62 reduces along shoulder 64 to a step 66, which is substantially identical in outside diameter to adjoining upset surface 16 on a tube body length, such as previously described. Weld 68 joins the tube body to the tool joint at this junction location.

FIG. 3 illustrates yet another tool joint for joining to a tool body of the type previously described. Both the pin and box connector ends are approximately five feet long and have an intermediate recess 80*a* and 80*b* between enlarged external diameter areas 82*a* and 82*b* at the tool joint end and protector areas 84*a* and 84*b* near the welds. The protector areas respectively are stepped, as with the other embodiments, to a straight, non-tapered surface aligned with the straight surfaces of the adjacent tubular body upsets. Welds 86*a* and 86*b* connect the respective tool joints to the tube body at these junction locations.

Although several embodiments have been shown and described, it will be understood that the invention is not limited thereto since many modifications may be made and will become apparent to those skilled in the art.

What is claimed is:

1. A drill stem member, comprising
   - a tubular body being sufficiently rigid for operating under compression while adding weight to the drill stem near the drill bit and being sufficiently flexible for negotiating commonly encountered borehole dog-legs, said body having a wall thickness of at least 0.620 inches, said body having upper and lower upset ends,
   - a bottom tool joint having a threaded connection lower end for connection to an adjoining drill stem member, and an upper end with a wall dimension equal to said lower upset of said body,
   - a first weld joining said body lower upset end and said upper end of said bottom tool joint,
   - a top tool joint having
     - a threaded connection upper end for connection to an adjoining drill stem member,
     - a lower end with a wall dimension equal to said top upset end of said body, and
     - a reduced external diameter intermediate length between its threaded upper end and its lower end to provide a lifting surface above said intermediate length, and
   - a second weld joining said body upset end and said lower end of said top tool joint.

2. A drill stem member in accordance with claim 1, wherein said upset ends of said body are external.

3. A drill stem member in accordance with claim 1, wherein said bottom tool joint includes a reduced external diameter intermediate length between its threaded lower end and its upper end.

4. A drill stem member in accordance with claim 1, wherein said top tool joint includes a second reduced external diameter intermediate length separated from said first reduced length by an enlarged external diameter length.

5. A drill stem member in accordance with claim 1, wherein said first and second welds are made respectively on nontapered surfaces between said upset ends of said body and said tool joint ends.

6. A drill stem member in accordance with claim 1, wherein said tubular body length is approximately two-thirds the overall length of the drill stem member.

7. A drill stem member in accordance with claim 6, wherein the wall thickness of said tubular body between a location just above said first weld and just below said second weld is of substantially uniform thickness.

8. A drill stem member in accordance with claim 1, wherein the annular bore therethrough is of substantially uniform diameter between said threaded connection lower end and said threaded connection upper end.

9. A drill stem member in accordance with claim 1, wherein said upper and lower upset ends have a wall thickness at least 20 percent greater than the wall thickness of said tubular body.

10. A drill stem member in accordance with claim 1, wherein the wall thickness of said reduced external diameter intermediate length of said top tool joint approximately equals the wall thickness of said tubular body.

11. A drill stem member in accordance with claim 1, wherein said reduced external diameter intermediate length of said top joint is at least 30 inches long and the length of said top joint is at least 5½ feet.

12. A drill stem member, comprising a tubular body being sufficiently rigid for operating under compression while adding weight to the drill stem near the drill bit and being sufficiently flexible for negotiating commonly encountered borehole dog-legs, said body having upper and lower external upset ends, a bottom tool joint having a threaded connection lower end for connection to an adjoining drill stem member, and an upper end with a wall dimension equal to said lower upset end of said body, a first weld joining said body lower upset end and said upper end of said bottom tool joint, a top tool joint having a threaded connection upper end for connection to an adjoining drill stem member, a lower end with a wall dimension equal to said top upset end of said body, and a reduced external diameter intermediate length between its threaded upper end and its lower end to provide a handling surface above said intermediate length, and a second weld joining said upper upset end and said lower end of said top tool joint.

13. A drill stem member in accordance with claim 12, wherein said tubular body length is approximately two-thirds the overall length of the drill stem member.

14. A drill stem member in accordance with claim 10, wherein said bottom tool joint and said top tool joint are made of high strength, heat treated alloy steel and said tubular body is made of a lower strength steel.

* * * * *